US006611240B2

(12) United States Patent
Robinson

(10) Patent No.: US 6,611,240 B2
(45) Date of Patent: Aug. 26, 2003

(54) ANTENNA HAVING REVERSIBLY RETAINED TORQUE WRENCH INTENDED TO ASSIST IN TIGHTENING THE ANTENNA

(75) Inventor: Richard C. Robinson, Cedar Grove, NJ (US)

(73) Assignee: Adronics Elrob Manufacturing Corporation, Cedar Grove, NJ (US)

( * ) Notice: Subject to any disclaimer, the term of this patent is extended or adjusted under 35 U.S.C. 154(b) by 0 days.

(21) Appl. No.: 09/990,608

(22) Filed: Nov. 21, 2001

(65) Prior Publication Data

US 2003/0048236 A1 Mar. 13, 2003

Related U.S. Application Data

(60) Provisional application No. 60/318,433, filed on Sep. 10, 2001.

(51) Int. Cl.[7] ..... H01Q 1/12

(52) U.S. Cl. ..... 343/906; 343/892

(58) Field of Search ..... 343/906, 882, 343/892, 715, 878, 709, 713; 248/539

(56) References Cited

U.S. PATENT DOCUMENTS 4,192,215 A * 3/1980 Hymans ..... 85/36
5,453,756 A * 9/1995 Lowrey ..... 343/892

* cited by examiner

*Primary Examiner*—James Clinger

(57) ABSTRACT

An antenna having a reversibly retained torque wrench. The torque wrench has a deformable lip region of the upper portion of its hollow inner region that allows the torque wrench to be reversibly retained, or coupled, within a wrench coupling region of the antenna during shipping and uncoupled after installation. The torque wrench also is capable of assisting in installing the antenna on its intended base structure by coupling a lower portion of its hollow inner region over a multi-sided torquing region of the lower attachment portion of the antenna and twisting its outer region to tighten the antenna onto its base structure.

16 Claims, 2 Drawing Sheets

ANTENNA HAVING REVERSIBLY RETAINED TORQUE WRENCH INTENDED TO ASSIST IN TIGHTENING THE ANTENNA

CROSS REFERENCE TO RELATED APPLICATION

The present application claims priority from U.S. Provision Application Ser. No. 60/318433, filed Sep. 10, 2001, entitled "Antenna Having Reversibly Retained Torque Wrench Intended To Assist In Tightening The Antenna."

TECHNICAL FIELD

The present invention relates generally to antennas and, more specifically, to antennas having a reversibly retained torque wrench intended to assist in tightening of the antenna.

BACKGROUND OF THE INVENTION

Removable antennas for use on an automobile are well known. Current removable antennas are installed, typically by hand tightening, to its associated base on the automobile, at the time of delivery and are susceptible to inadvertent loosening or detachment. Loosened antennas are also susceptible to breakage when not securely attached to its associated base. Also, tightened antennas are important in receiving and transmitting signals such as radio broadcast waves.

One proposed solution to this problem is to form a torquing region on the antenna. The installer may then apply a torque wrench to the torquing region to tighten the antenna to its associated base. This minimizes the above problems associated with loose or detached antennas. However, if the installer is unable to find a torque wrench that fits onto the torquing region, either through shipping error or otherwise, the proposed solution is useless. Ideally, a proper fitting torque wrench would be readily available for use by the installer to install the antenna to its associated base.

Similarly, it would be ideal if the torque wrench would be subsequently available to end-users such as consumers, so that it may be used to retighten or loosen the antenna as desired. Thus, for example, the antenna may be removed by a consumer while entering a car wash to prevent breakage and subsequently reinstalled after exiting.

It is therefore highly desirable to provide a torque wrench for an antenna that would not be misplaced during shipping so that an installer can properly tighten the antenna to its associated base during installation.

SUMMARY OF THE INVENTION

It is therefore an object of the present invention to provide a torque wrench for tightening an antenna that can be easily stored and secured during shipping to prevent loss thereof.

The present invention addresses the problems describe above by providing an antenna having a reversibly attached torque wrench that may be used by an installer to properly tighten the antenna to the base of a vehicle, boat or system in which the antenna is used. The torque wrench is formed of a material that is capable of deforming over a portion of the antenna during shipping. The torque wrench is then removed from the antenna after the antenna is tightened onto the system. The torque wrench is capable of being stored in the vehicle or system after installation for subsequent tightening and loosening of the antenna.

Other objects and advantages of the present invention will become apparent upon considering the following detailed description and appended claims, and upon reference to the accompanying drawings.

DETAILED DESCRIPTION AND PREFERRED EMBODIMENTS OF THE INVENTION

Figure 1:
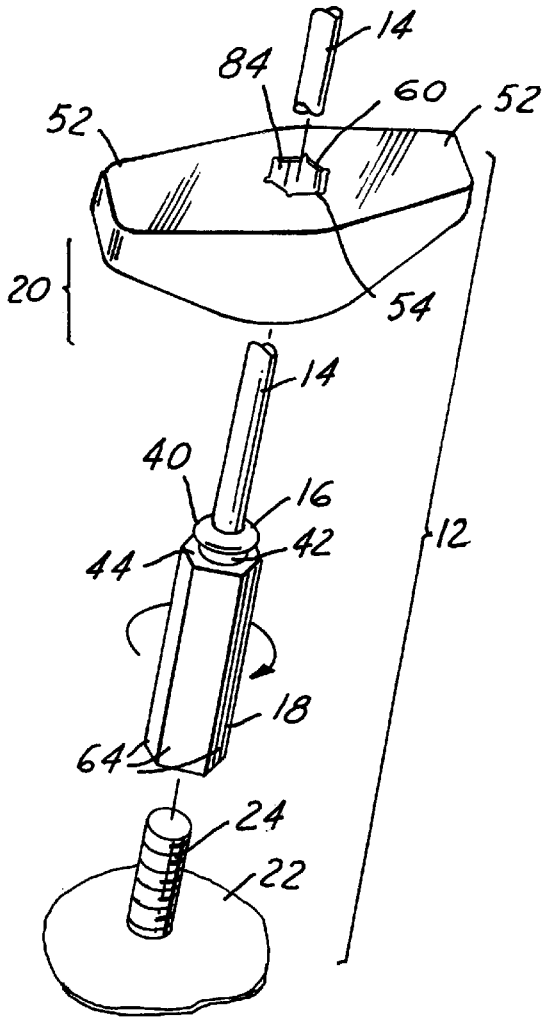
FIG. 1 is an exploded view of an antenna system according to a preferred embodiment of the present invention.
Figure 2:
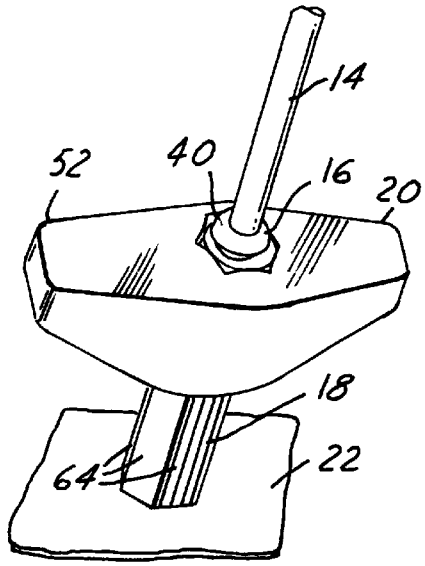
FIG. 2 is a perspective view of the antenna system in an assembled position according to a preferred embodiment of the present invention.

Referring now to FIGS. 1 and 2, an antenna system according to one preferred embodiment is depicted generally as 10. The antenna system 10 consists of an antenna 12, a torque wrench 20, and a base 22. The base 22 is a portion of an automobile, boat, or other system where an antenna 12 can be installed and utilized.

The antenna 12 consists of an integrally formed aerial region 14, a wrench-coupling region 16, and a lower attachment region 18. The aerial region 14 of the antenna 12 functions to receive and/or transmit signals in the form of waves from one or more signal generating stations, as is well known. These include, but are not limited to, broadcast waves from an AM/FM broadcasting station, broadcast waves from a television broadcast station, global position satellite ("GPS") waves from a GPS satellite, broadcast waves from a communication satellite, digital broadcast waves from a digital broadcast station, a keyless doorlock signal from a remote keyless entry station, and extremely high frequency ("EHF") radar signals from a EHF radar station. As is well known in the art, the waves received or transmitted through the aerial region 14 are sent through the base 22 to a control unit (not shown) on the system that can manipulate or otherwise use the received or transmitted signals. For example, the control unit may manipulate an AM/FM signal so that it may be broadcast through a radio on an automobile. The details of the how the signals are used and manipulated are well known in the art and are not a unique and essential feature of the present invention, and will not be described further herein.

The lower attachment region 18 contains a female threaded portion 30 that "mates" with a corresponding male threaded portion 24 of the base 22. Preferably, the female threaded portion 30 and the corresponding male threaded portion 24 are made of metal. However, other materials, such as plastics, such as may be used that are well known in the art.

Figure 5:
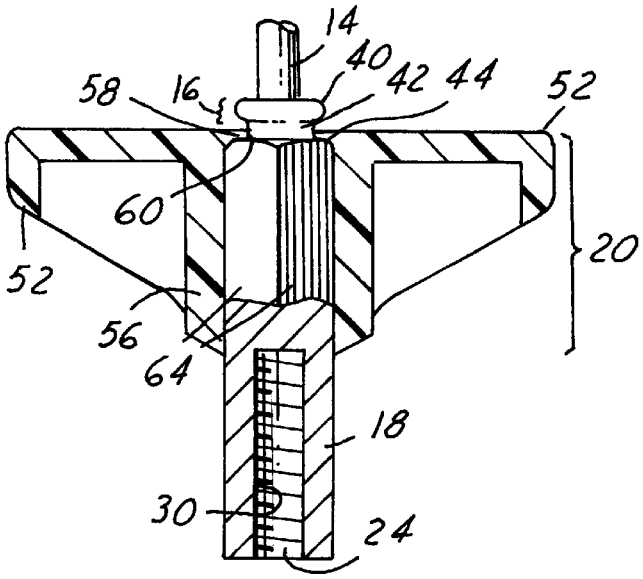
FIG. 5 is a section view of the antenna system of FIG. 3 taken along line 5—5.
Figure 6:
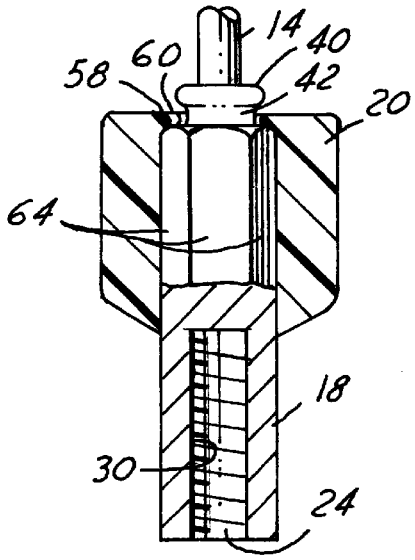
FIG. 6 is a section view of the antenna system of FIG. 3 taken along line 6—6.
Figure 7:
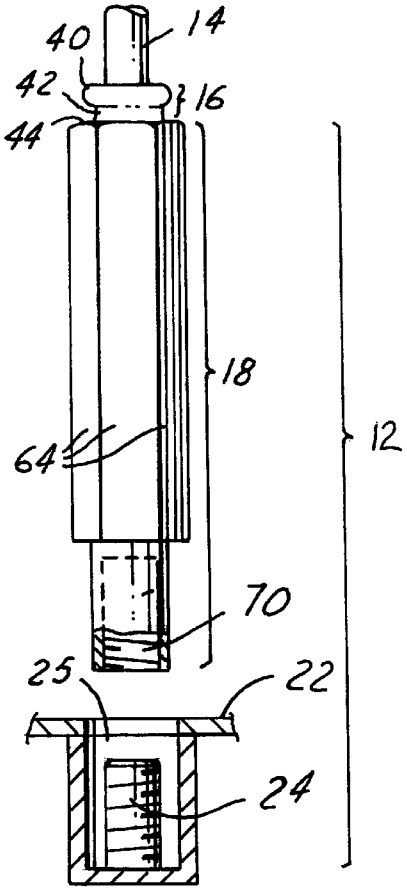
FIG. 7 is a perspective view of another preferred embodiment of an antenna system according to the present invention.
Figure 8:
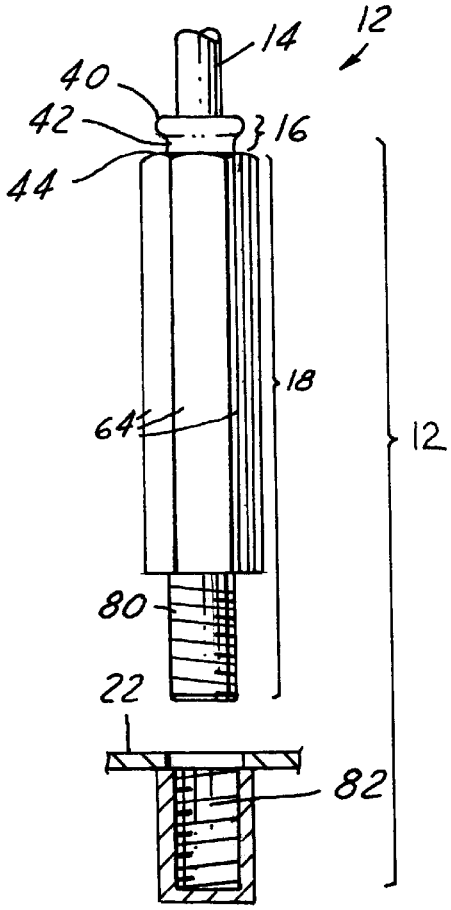
FIG. 8 is a perspective view of another preferred embodiment of an antenna system according to the present invention.

The female portion 30 is preferably contained within a portion of the lower attachment region 18, as best shown in FIGS. 5 and 6. However, as shown in an alternative preferred embodiment in FIG. 7, the female threaded portion 70 could alternatively be located substantially below the lower attachment portion 18 and mate to a corresponding male portion 24 that is contained within a recessed portion 25 of the base 22. In another alternative embodiment, as shown in FIG. 8, a male threaded portion 80 could be coupled below the lower attachment portion 18 and "mate" with a corresponding female portion 82 recessed within the base 22.

The lower attachment region 18 also contains an outer multi-sided torquing region 64. The torquing region 64 allows a correspondingly sided torque wrench 20 to be attached around its outer periphery to tighten the threaded portion 30, 70, 80 of the antenna 12 to the corresponding threaded portion 24, 24, 82 of the system together beyond a simple hand tightening. This is important in most applications, as loose antennas typically have a greater tendency to break or be lost than does a torque-tightened antenna. In the embodiments as shown in FIGS. 1, 2 and 4–8, the outer multi-sided torquing region 64, and the corresponding number of sides 84 of the torque wrench 20 is six-sided in a generally hexagonal shaped. However, the number of sides of the outer multi-sided torquing region 64 may be varied from as little as three to as many as 20 or more.

The antenna 12 also has a wrench coupling region 16 located between the aerial region 14 and the lower attachment region 18. The wrench-coupling region 16 has an inner grooved region 42 and an outer holding region 40 and is preferably located between the aerial region 14 and the topmost portion 44 of the lower attachment region 18. Of course, in other embodiments, the location of the wrench-coupling region 16 could be almost anywhere on the antenna 12 that does not affect the coupling of the antenna 12 to the system nor affects the performance of the antenna 12. The design of the wrench-coupling region 16 is such to secure a torque wrench 20 around the inner grooved region 42 during shipping and storage. The method for reversibly securing the wrench 20 to the wrench-coupling region 16 is described further below.

Preferably, the inner grooved region 42 and the outer holding region 40 are substantially symmetrical and annular in a cross-sectional view perpendicular to the major axis of the antenna 12. However, other embodiments could have an asymmetrical and non-annular inner grooved region 42 and/or an asymmetrical and non-annular outer holding region 40 and still fall within the spirit of the present invention.

Figure 3:
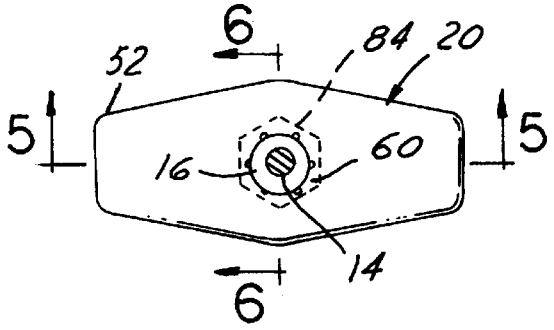
FIG. 3 is a top view of the antenna system of FIG. 2.
Figure 4:
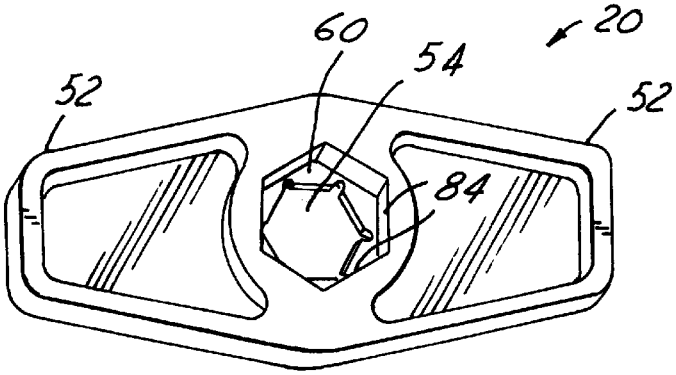
FIG. 4 is a perspective view of the torque wrench of FIG. 2.

As best seen in FIGS. 3 and 4, the wrench 20 contains a pair of outer regions 52 and a hollow inner region 54. The hollow inner region 54 has a lower portion 56 that is shaped to couple over the outer multi-sided torquing region 64 and is intended to assist in tightening or loosening the antenna 12 to the base 22 of an automobile or other system requiring an antenna 12 when the wrench 20 is turned. The hollow inner region 54 also has an upper portion 58 having a thin, deformable region 60 that allows the upper portion 58 to reversibly deform over the outer holding region 40 and spring back within the inner grooved region 42, thereby securing the wrench 20 to the antenna 12. The material used in the thin, deformable region 60 must therefore be readily deformable yet have enough strength so as not to break or irreversibly bend when the wrench 20 is secured to the wrench-coupling region 16.

Further, the material used in the outer regions 52 of the wrench 20 must be strong enough to tighten or loosen the antenna 12 in a post-shipping step, as would be understood in the art. Preferably the material used in the wrench 20 is a deformable, yet tough, plastic material that is easily molded by an injection molding process or other process that is well known in the art. One such plastic is polypropylene, however other plastics, or combinations of plastics, that are easily moldable, tough, and deformable that are well known in the art may be used as well. Of course, different types of plastics, or combinations of plastics and other materials, may be used in either the outer regions, the hollow inner region, or both, as may be contemplated in the art to give a combination of deformable and strength properties within the wrench 20.

Thus, the present invention improves upon the prior art in many ways. First, the present invention provides a method for torque tightening the antenna 12 to its system of use. This minimizes problems associated with breaking or losing antennas after installation and problems associated with receiving and transmitting signals. Second, the present invention provides an easily accessible torque wrench 20 that is coupled to the antenna 12 during shipping that can be used to install the antenna 12 post-shipping. The wrench 20 is designed with materials that allow the wrench 20 to be reversibly coupled to the antenna 12 during shipping and strong enough to tighten or untighten the antenna 12 after shipping.

While the invention has been described in terms of preferred embodiments, it will be understood, of course, that the invention is not limited thereto since modifications may be made by those skilled in the art, particularly in light of the foregoing teachings.

What is claimed is:

1. A removable antenna system comprising:

an antenna having an aerial portion, a wrench coupling region, and a lower attachment region, wherein said wrench coupling region comprises an inner grooved region and an outer holding region, said inner grooved region being in closest proximity with said lower attachment region; and a torque wrench capable of being reversibly secured to said antenna during shipping, said torque wrench also being capable of tightening said antenna to an associated base and loosening said antenna from said associated base, wherein said torque wrench has a pair of outer regions and a hollow inner region, said hollow region having an upper portion and a lower portion, wherein said upper portion has a deformable region, said deformable region capable of being reversibly deformed over said outer holding region and reformed around said inner grooved region, thereby reversibly securing said torque wrench to said antenna.

2. The removable antenna system of claim 1, wherein said lower attachment region has an outer multi-sided torquing region.

3. The removable antenna system of claim 2, wherein said lower attachment region also has a first threaded portion and wherein said associated base has a second threaded portion, said first threaded portion capable of mating with a second threaded portion to attach said antenna to said associated base.

4. The removable antenna system of claim 3 wherein said first threaded portion is a male threaded portion and said second threaded portion is a female threaded portion.

5. The removable antenna system of claim 3, wherein said first threaded portion is a female threaded portion and said second threaded portion is a male threaded portion.

6. The removable antenna of claim 5, wherein said female threaded portion is contained within said multi-sided torquing region.

7. The removable antenna of claim 1, wherein said lower portion of said hollow inner region is shaped similarly to said outer multi-sided torquing region such that said lower portion may fit over said outer multi-sided torquing region to tighten said antenna to said associated base or to loosen said antenna from said associated base depending upon which way said torque wrench is twisted.

8. The removable antenna of claim 1, wherein said torque wrench is composed of a plastic material.

9. The removable antenna of claim 8, wherein said plastic material is polypropylene.

10. The removable antenna of claim 8, wherein said plastic material is a moldable plastic material.

11. A removable antenna for use on an automobile, boat, or other system having a base structure comprising:

an aerial portion;

a lower attachment region; and a wrench coupling region, wherein said wrench coupling region comprises an inner grooved region and an outer holding region, said inner grooved region being in closest proximity with said lower attachment region.

12. The antenna of claim 11, wherein said lower attachment region comprises an outer multi-sided torquing region and a first threaded portion, said first threaded portion capable of mating with a second threaded portion of the base structure to attach said antenna to the base structure.

13. The antenna of claim 12 further comprising a torque wrench made of a deformable, yet tough plastic material that is reversibly coupled to said wrench coupling region of the antenna, wherein said torque wrench has a pair of outer regions and a hollow inner region, said hollow region having an upper portion and a lower portion, wherein said lower portion of said hollow inner region is shaped similarly to said outer multi-sided torquing region such that said lower portion may fit over said outer multi-sided torquing region to tighten said antenna to the base structure or to loosen said antenna from the base structure depending upon which way said torque wrench is twisted.

14. The antenna of claim 13, wherein said upper portion has a deformable region, said deformable region capable of being reversibly deformed over said outer holding region and reformed around said inner grooved region, thereby reversibly securing said torque wrench to said antenna.

15. The antenna of claim 12, wherein said first threaded portion comprises a female threaded portion, and wherein said female threaded portion is substantially contained within said multi-sided torquing region.

16. A car having an antenna system comprising:

a base;

an antenna capable of being reversibly coupled to said base, said antenna comprising an aerial portion, a wrench coupling region, and a lower attachment region; and a torque wrench capable of being reversibly coupled to said wrench coupling region of said antenna, said torque wrench also being capable of coupling with said lower attachment region to tighten said antenna to said base or to loosen said antenna from said base.

* * * * *